US006607262B2

(12) United States Patent
Paul et al.

(10) Patent No.: US 6,607,262 B2
(45) Date of Patent: Aug. 19, 2003

(54) RESERVING INK FOR PRINTER SERVICING PURPOSES

(75) Inventors: Ronald G. Paul, Vancouver, WA (US); Rory A. Heim, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 18 days.

(21) Appl. No.: 09/883,823

(22) Filed: Jun. 18, 2001

(65) Prior Publication Data

US 2002/0191042 A1 Dec. 19, 2002

(51) Int. Cl.[7] ..... B41J 2/165

(52) U.S. Cl. ..... 347/22; 347/23; 347/7; 347/19; 347/43; 347/30; 347/35; 347/29

(58) Field of Search ..... 347/22, 27, 7, 347/14, 29, 30, 35, 19, 23, 43

(56) References Cited

U.S. PATENT DOCUMENTS

| | | | | |
|---|---|---|---|---|
| 5,355,159 | A | | 10/1994 | Kaneko |
| 5,659,342 | A | | 8/1997 | Lund et al. |
| 5,682,183 | A | | 10/1997 | Wade et al. |
| 5,699,090 | A | | 12/1997 | Wade et al. |
| 5,757,390 | A | | 5/1998 | Gragg et al. |
| 5,760,795 | A | | 6/1998 | Beck |
| 5,812,156 | A | | 9/1998 | Bullock et al. |
| 5,835,817 | A | | 11/1998 | Bullock et al. |
| 6,048,045 | A | | 4/2000 | Nohata et al. |
| 6,070,964 | A | * | 6/2000 | Sumiya ..... 347/43 |
| 6,106,108 | A | | 8/2000 | Cluet |
| 6,123,406 | A | | 9/2000 | Imai |
| 6,195,173 | B1 | | 2/2001 | Kato |
| 6,196,663 | B1 | | 3/2001 | Wetchler et al. |
| 6,409,302 | B2 | * | 6/2002 | Altfather et al. ..... 347/19 |

FOREIGN PATENT DOCUMENTS

| | | |
|---|---|---|
| EP | 0589581 | 3/1994 |
| EP | 0778140 | 6/1997 |
| EP | 1025997 | 8/2000 |

OTHER PUBLICATIONS

British Search Report dated Jul. 7, 2002.

* cited by examiner

*Primary Examiner*—John Barlow
*Assistant Examiner*—Ly T Tran

(57) ABSTRACT

An inkjet printing system and method that enables printing to continue after an ink supply has been depleted without damaging the printhead associated with the depleted ink supply. The method detects whether less than a predetermined reserve amount of ink remains in a depleted ink supply and, if so, then ink drops will be ejected from that depleted ink supply only during servicing operations. Since ink drops from non-depleted ink supplies will still be ejected during both printing operations and servicing operations, printing can continue, though possibly with reduced image quality. This is particularly advantageous in printing systems that include fax capability, since fax messages that cannot be printed may be lost.

31 Claims, 8 Drawing Sheets

SWATH OF PRINT DATA
5A
5B

80b
MEMORY
CONTROLLER
PRINT MODE(S)
84b
PRINT DATA PROCESSING ALGORITHM
84a
10
29
SENSOR
82a
PRINT MEDIUM 80a
82
16
18
12
SENSOR
82b
PRINT HEAD
INK DROPS
22
INK CARTRIDGE
INK RESERVOIR 13
INK SUPPLY 15

RESERVING INK FOR PRINTER SERVICING PURPOSES

FIELD OF THE INVENTION

The present invention relates generally to inkjet printing, and pertains more particularly to operation of an inkjet printing system as an ink supply nears exhaustion.

BACKGROUND OF THE INVENTION

Hardcopy output devices, such as printers and fax machines, frequently make use of an inkjet printhead mounted within a carriage that is moved relative to a print medium, such as paper. Hardcopy devices of this sort are described by W. J. Lloyd and H. T. Taub in "Ink Jet Devices" ,Chapter 13 of *Output Hardcopy Devices* (Ed. R. C. Durbeck and S. Sherr, San Diego: Academic Press, 1988). As the printhead is moved relative to the print medium, a control system selectively activates individual printing elements in the printhead to deposit or eject ink droplets onto the print medium to form printed output that may include images and text. Ink is provided to the printhead from a supply of ink. An inkjet hardcopy device typically uses several different color ink supplies, each with an associated printhead, to produce color print output. A typical set of color inks includes cyan, magenta, yellow, and black inks. During printing, drops of different ones of these inks may be deposited in the same or adjacent locations to form a range of colors. Further information as to the basics of inkjet printing technology are further disclosed in various articles in several editions of the *Hewlett-Packard Journal*[Vol. 36, No. 5 (May 1985), Vol.39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference.

In order to ensure that the printed output is of high quality, it is critical that proper care of the printhead is taken during both operation and non-operation. If printing is attempted after the supply of ink has run out, the printing elements can be damaged from the entry of air into the printhead such that they will no longer operate properly when a new ink supply is provided. Similarly, care must be taken to ensure that moisture in the nozzles of the printing elements not dry out. When the printhead is not in operation, the nozzles are typically mechanically capped to retain moisture. During operation, when the nozzles are not capped but instead are exposed to air, the printing elements are periodically serviced, typically by ejecting drops of the ink into a spittoon, in order to keep the nozzles moist.

Since the color of the printed output may require that more of one certain color ink be used than of a different color ink, the ink supplies may become exhausted at different times. In hardcopy devices where the ink reservoir containing the supply of ink is integrally formed with the printhead in a print cartridge, both the ink reservoir and the printhead are replaced when the supply of ink is exhausted, so it does not matter if the printhead is damaged by attempting to print after the supply of ink is exhausted.

However, in other hardcopy devices where the ink reservoir is contained in an ink cartridge that is separate from and fluidically coupled to the printhead, the ink cartridge and the printhead are separately replaceable. While the ink cartridge is replaced when the supply of ink is exhausted, the printhead is generally not replaced until the end of its useful life, which typically is much longer than the life of a single ink supply. As a result, care must be taken to avoid printing once an ink supply is exhausted so as not to damage the corresponding printhead.

The amount of remaining ink in an ink supply can be automatically determined by the hardcopy device, and therefore it is possible for the hardcopy device to stop printing just before the supply of ink runs out, and prevent any further printing until the ink supply is replaced. While this behavior will prevent damage to the printhead, it is often otherwise undesirable. For example, the incoming fax data can't be stored in certain types of fax machines; rather, it must be printed out at the time it is received or it will be lost. Also, in many printing devices a single ink cartridge may contain two or more color ink supplies in separate ink reservoirs, with a frequently-used combination including the cyan, magenta, and yellow inks in a tri-color ink cartridge. Since one of these color inks is likely to become exhausted while ink remains in the other reservoirs, requiring the user to replace a multi-color ink cartridge before printing can continue results in discarding the remaining supplies of ink for the non-exhausted colors.

Accordingly, it would be highly desirable to have a new and improved hardcopy printing method and system that allows the user to continue printing with the remaining color inks after one color ink has been exhausted without damaging the printhead associated with the exhausted ink supply.

SUMMARY OF THE INVENTION

In a preferred embodiment, the present invention provides a method of printing with an inkjet printer having a plurality of ink supplies. If the method detects that less than a predetermined reserve amount of ink remains in a depleted ink supply, then ink drops will be ejected from that depleted ink supply only during servicing operations. Since ink drops from non-depleted ink supplies will still be ejected during both printing operations and servicing operations, the user can advantageously continue printing after an ink supply has been depleted without damaging the printhead associated with the depleted ink supply.

BRIEF DESCRIPTION OF THE DRAWINGS

The above-mentioned features of the present invention and the manner of attaining them, and the invention itself, will be best understood by reference to the following detailed description of the preferred embodiment of the invention, taken in conjunction with the accompanying drawings, wherein.

DESCRIPTION OF THE PREFERRED EMBODIMENT

Figure 1:
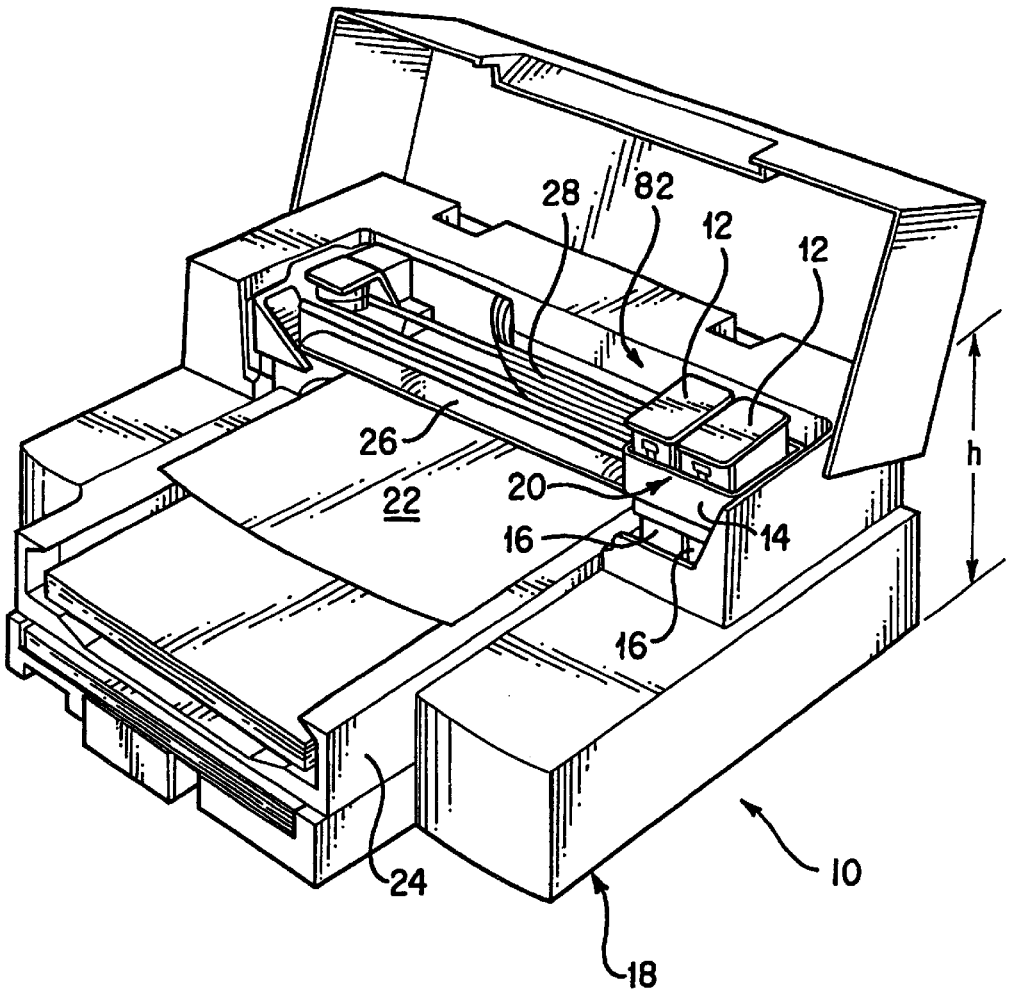
FIG. 1 is a perspective view of a printing system according to the present invention.

Referring now to the drawings, there is illustrated a printing system and method constructed in accordance with the present invention which detect the impending depletion of an ink supply and subsequently modify printing behavior so as to allow the printing system to continue printing for an extended period of time without replacing the ink supply and without damage to any of the printing elements of the printing system. A preferred embodiment of such a printing system includes at least one replaceable ink cartridge. Each ink cartridge contains at least one ink reservoir which holds a supply of an ink. A printhead for ejecting drops of the ink is fluidically coupled to an individual ink reservoir. An ink level detection arrangement in the printing system determines whether the amount of the ink in any reservoir is less than a predetermined reserve level. If so, a drop ejection arrangement inhibits drop ejection from the printhead which is coupled to that ink reservoir during printing operations, while still enabling drop ejection from that printhead during servicing operations. The use of the reserve amount of ink solely to perform servicing operations allows the printing system to continue printing with other ink supplies that have not been depleted, while using the reserve amount of ink in the depleted ink reservoir to prevent air from entering the printhead, and to keep the nozzles and other portions of the printing elements from drying out while the printheads are decapped.

Considering a preferred embodiment of the printing system 10 in further detail, and with reference to FIG. 1, the printing system 10 includes at least one replaceable ink cartridge 12 that is installed in a receiving station 14. With the replaceable ink cartridge 12 properly installed into the receiving station 14, ink is provided from the replaceable ink cartridge 12 to at least one inkjet printhead 16. The inkjet printhead 16 is responsive to activation signals from a printer portion 18 to deposit ink drops on a print medium 22. As ink drops are ejected from the printhead 16, the printhead 16 is replenished with ink from an ink supply in the cartridge 12.

In one preferred embodiment, the replaceable ink cartridge 12, receiving station 14, and inkjet printhead 16 are each part of a scanning carriage 20 that is moved relative to a print medium 22 during a printing operation to accomplish printing on the medium 22. The printer portion 18 includes a media tray 24 for receiving the print media 22. As the print medium 22 is stepped through a print zone, the scanning carriage 20 moves the printhead 16 relative to the print medium 22. The printer portion 18 selectively activates the printhead 16 to deposit ink on the print medium 22 to perform printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print medium 22 through the print zone as the scanning carriage 20 is moved along the scan axis. As will be described subsequently in greater detail, electrical signals from a print controller 29 are provided to the scanning carriage 20 for selectively activating the printhead 16. These electrical signals are communicated to the printhead 16 via an electrical link such as a ribbon cable 28.

Figure 2:
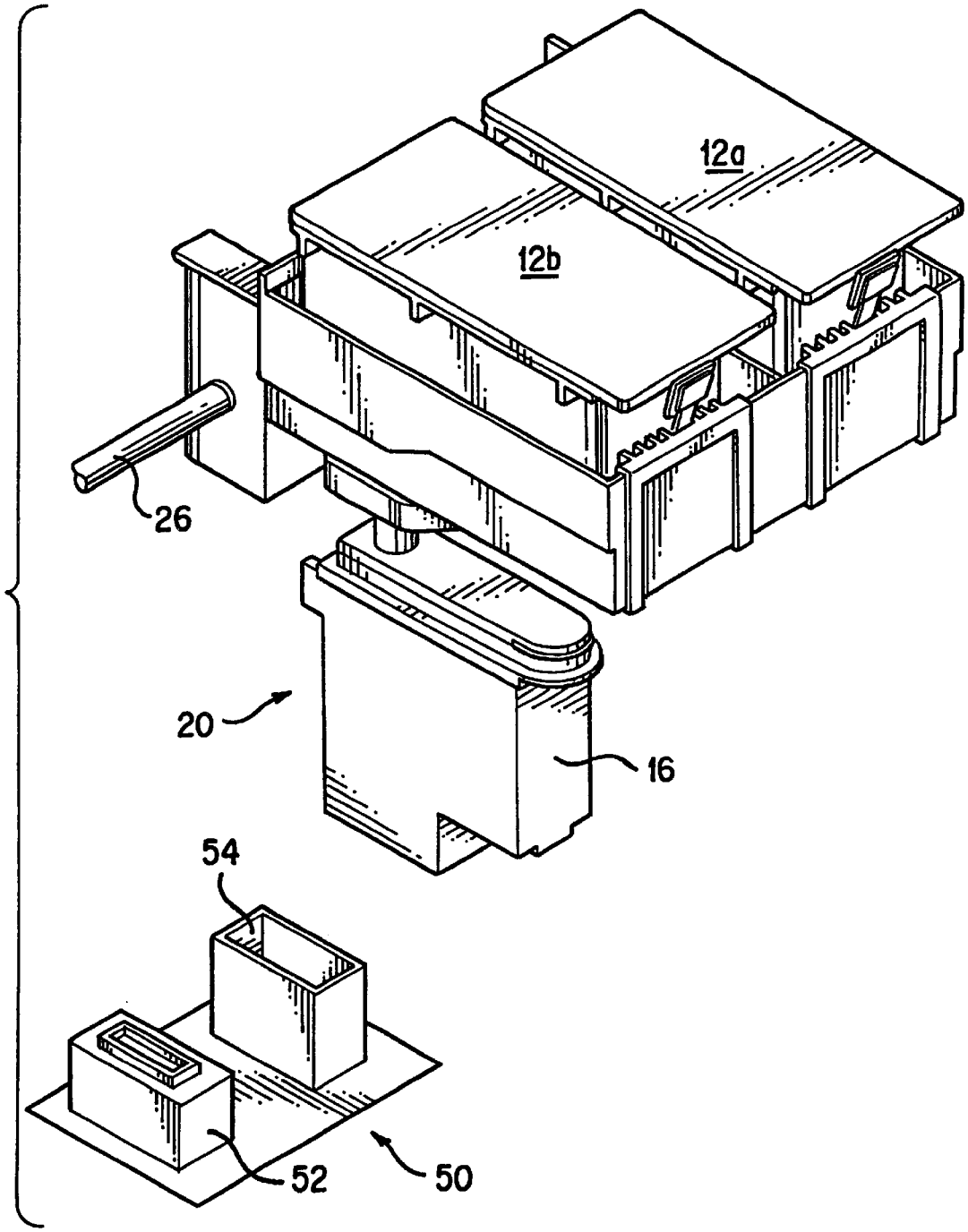
FIG. 2 is a schematic diagram of a portion of the printing system of FIG. 1 illustrating the elements of a scanning carriage and a service station.
Figure 3A:
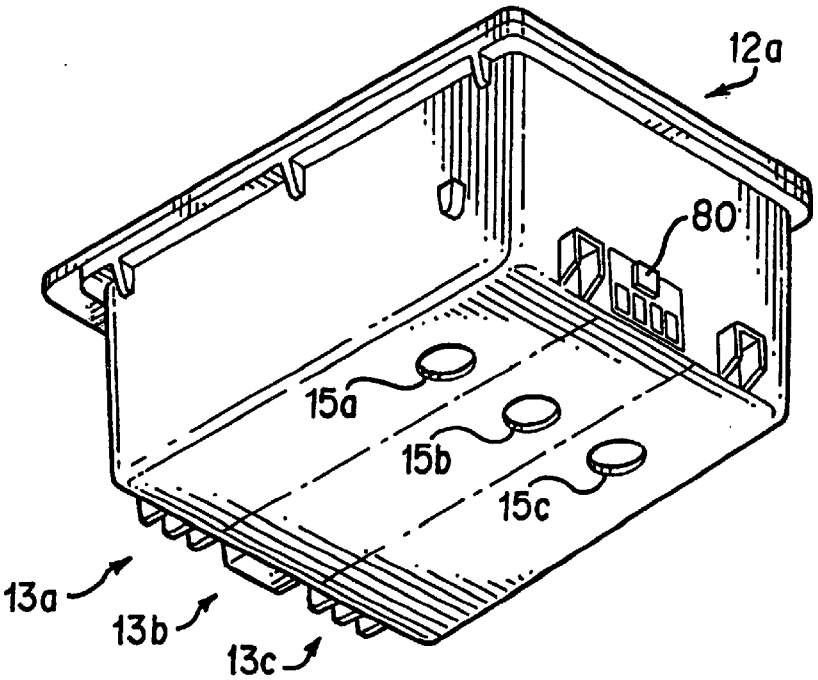
FIG. 3A is a perspective views of an ink cartridge installable in the scanning carriage of FIG. 2 and having a single ink reservoir.
Figure 3B:
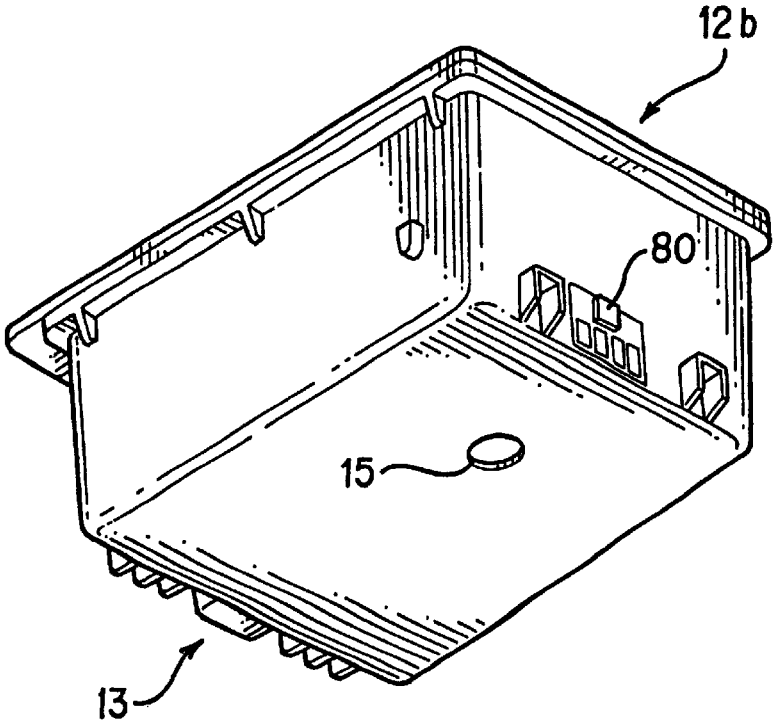
FIG. 3B is a perspective views of an ink cartridge installable in the scanning carriage of FIG. 2 and having three ink reservoirs.

Considering now the ink cartridge 12 and printhead 16 arrangement in further detail, and with reference to FIGS. 2, 3A, and 3B, in a preferred embodiment the receiving station 14 can accommodate multiple ink cartridges 12. When properly installed in the receiving station 14, the ink cartridges 12 are maintained in fluidic communication with the printheads 16. Two such ink cartridges 12*a,b* are illustrated in FIG. 2 by way of example, preferably a tri-color ink cartridge 12*a* containing three separate ink reservoirs 13*a, b,c* for three separate supplies of ink and a single-color ink cartridge 12*b* containing a single reservoir 13 for ink. In this preferred embodiment, the tri-color ink cartridge 12*a* contains cyan, magenta, and yellow inks, and the single-color ink cartridge 12*b* contains black ink for accomplishing four-color printing. The replaceable ink cartridges 12 can be partitioned differently to contain ink reservoirs for fewer than three ink colors or more than three ink colors if required. For example, in the case of high fidelity printing, frequently six or more colors are used to accomplish printing; in such a system, the first ink cartridge 12*a* has three ink reservoirs for supplies of dark cyan, light cyan, and black inks, and the second ink cartridge 12*b* has three ink reservoirs for supplies of dark magenta, light magenta, and yellow inks. Alternatively, each ink cartridge 12 may include only a single ink reservoir 13, in which case a typical printing system 10 would include four ink cartridges 12, one each for magenta, cyan, yellow, and black ink supplies. With regard to the structure of the ink reservoir 13, some preferred embodiments include a collapsible bag (not shown) containing the ink supply, while others include an absorbent insert (not shown) impregnated with the ink supply.

Regardless of the colors of the inks and the partitioning of ink reservoirs 13 among ink cartridges 12, each ink reservoir 13 is preferably fluidically coupled to a different printhead 16 (for simplicity, only one printhead 16 is illustrated in FIG. 2). In the preferred embodiment, four inkjet printheads 16 are each fluidically coupled to the receiving station 14. In this preferred embodiment, each of the four printheads are fluidically coupled to each of the four colored inks contained in the replaceable ink cartridges 12. Thus, the cyan, magenta, yellow and black printheads 16 are each coupled to their corresponding cyan, magenta, yellow and black ink supplies, respectively. Other configurations which make use of fewer than four printheads are also possible. For example, the printhead 16 can be configured to print more than one ink color by properly partitioning the printhead 16 to allow a first ink color to be provided to a first group of ink nozzles and a second ink color to be provided to a second group of ink printing elements, with the second group of ink printing elements different from the first group. In this manner, a single printhead 16 can be used to print more than one ink color, in turn allowing fewer than four printheads 16 to accomplish four-color printing. In a preferred embodiment, the printhead 16 is semi-permanent, and is detachable from the ink cartridge 12 and removable from the printing system 10. Since the life of a printhead 16 is typically spans as least several supplies of ink, printheads 16 are typically replaced less frequently than are ink cartridges 12. The fluidic coupling between the ink cartridge 12 and the printhead 16 are described in further detail in the co-pending U.S. application Ser. No. 09/495,060, by Steinmetz et al., filed Jan. 31, 2000, titled"Ink Container Configured to Establish Reliable Electrical and Fluidic Connections to a Receiving Station", which is assigned to the assignee of the present invention and hereby incorporated by reference in its entirety.

In order to perform servicing operations which clean and protect the printhead 16, a service station mechanism 50 is mounted within the printing system 10 so that the printhead 16 can be moved over the station 50 for maintenance. The service station 50 is typically located in the printing system 10 at one end of the path of travel of the scanning carriage 20 along the slide rod 26. For storage, or during non-printing periods, the service station 50 preferably includes a capping system 52 which hermetically seals the nozzles on each printhead 16 from contaminants and drying. In some embodiments, the capping system may also be designed to facilitate priming, such as by being connected to a pumping unit or other mechanism (not shown) that draws a vacuum on the printhead 16. During a servicing operation, clogs in the printhead 16 are periodically cleared by firing a number of drops of ink through some or all of the nozzles in a process known as "spitting", with the waste ink being collected in one or more "spittoon" reservoirs 54 of the service station 50. Service stations typically also include one or more wiping members (not shown) that wipe the printhead surface to remove ink residue, as well as any paper dust or other debris that has collected on the face of the printhead. Routine servicing operations are typically scheduled once or twice per page of printing. Printhead servicing operations and the structure of service stations are well known to those skilled in the art.

Before considering in further detail the ink level detection arrangement and drop ejection arrangement of the printing system 10, it is useful to consider a novel printing method according to the present invention which detects the impending depletion of an ink supply and subsequently modifies printing behavior so as to allow the printing system to continue printing for an extended period of time without replacing the ink supply and without damage to any of the printing elements of the printing system. As will be discussed in further detail below, the method detects whether less than a predetermined reserve amount of ink remains in a depleted ink supply. If so, then ink drops will be ejected from the depleted ink supply only during only servicing operations, while ink drops will continue to be ejected from other ink supplies during both printing operations and servicing operations. In this way, the printing system can continues to print (often with reduced image quality, since one of the ink colors will not print) without damage to the printhead connected to the depleted ink supply. Where the depleted ink supply is in one of the reservoirs of a multi-reservoir ink cartridge, the useful life of that ink cartridge can be extended, and particularly in the case where the printing system includes a fax machine, it ensures that fax messages are not missed because one ink supply is depleted.

Figures 4, 5:
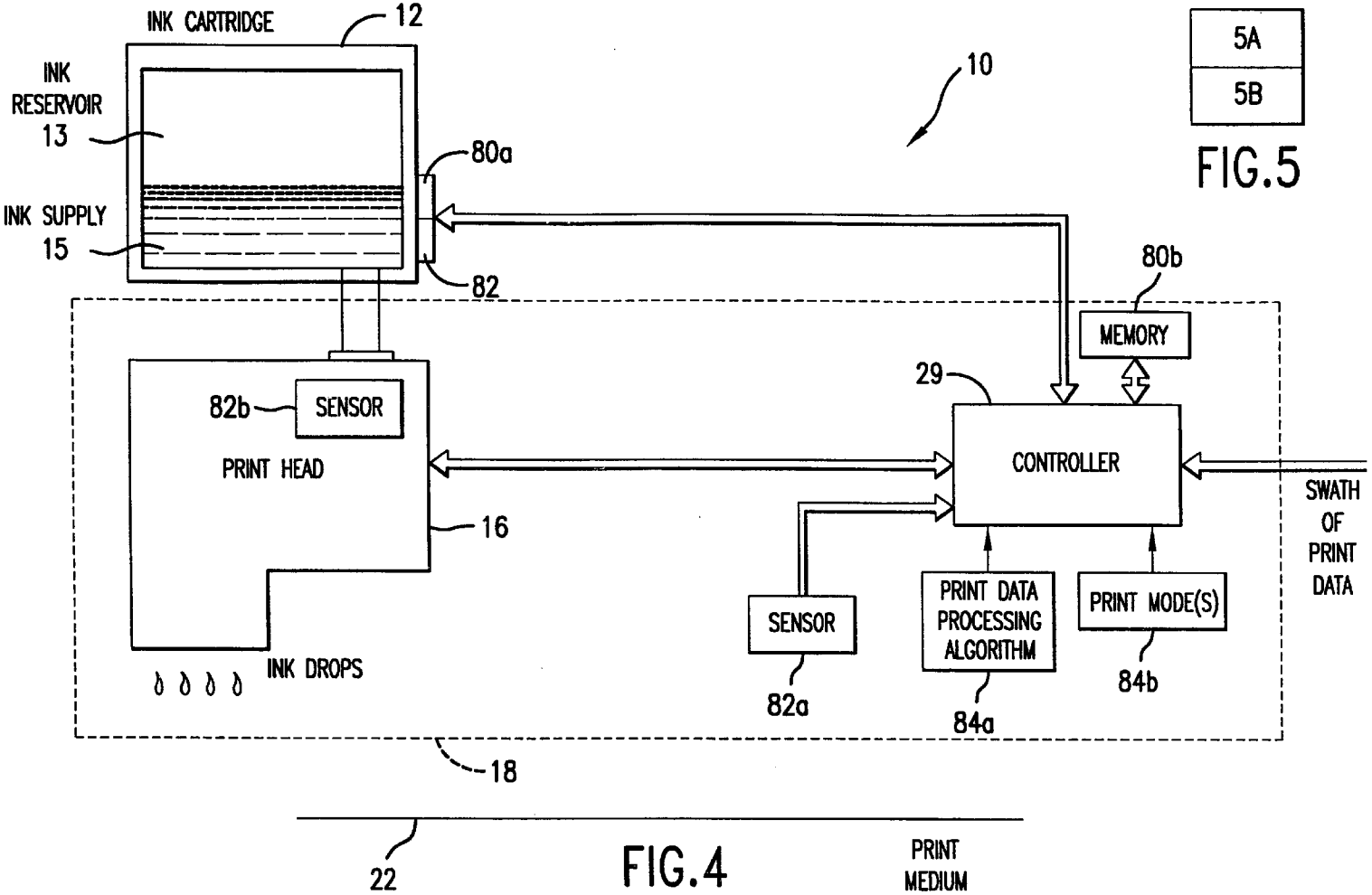
FIG. 4 is a schematic diagram of certain electrical and fluidic communications within the printing system of FIG. 1.
FIG. 5 is a flowchart of a printing method usable with the printing system of FIG.
Figure 5A:
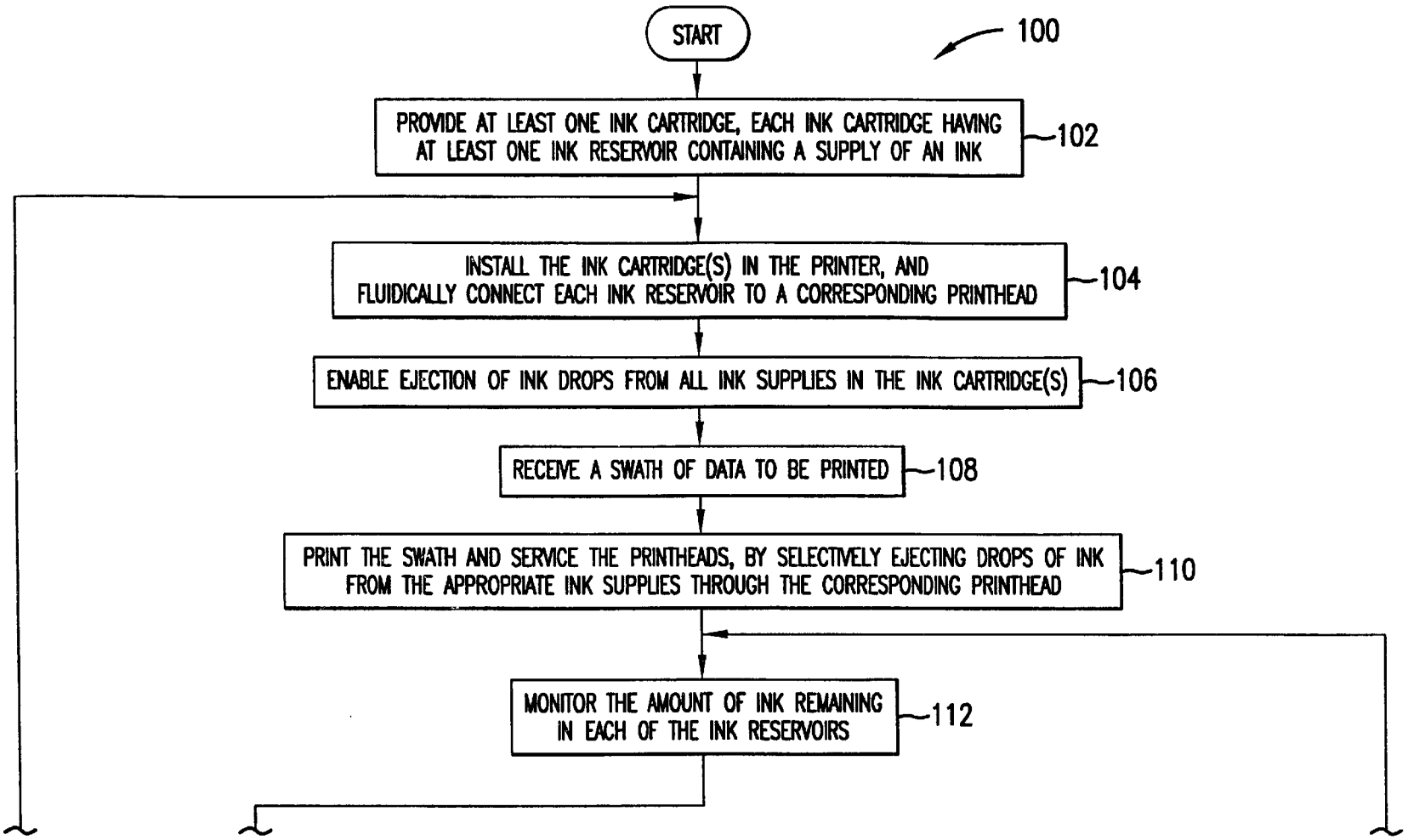
Figure 5B:
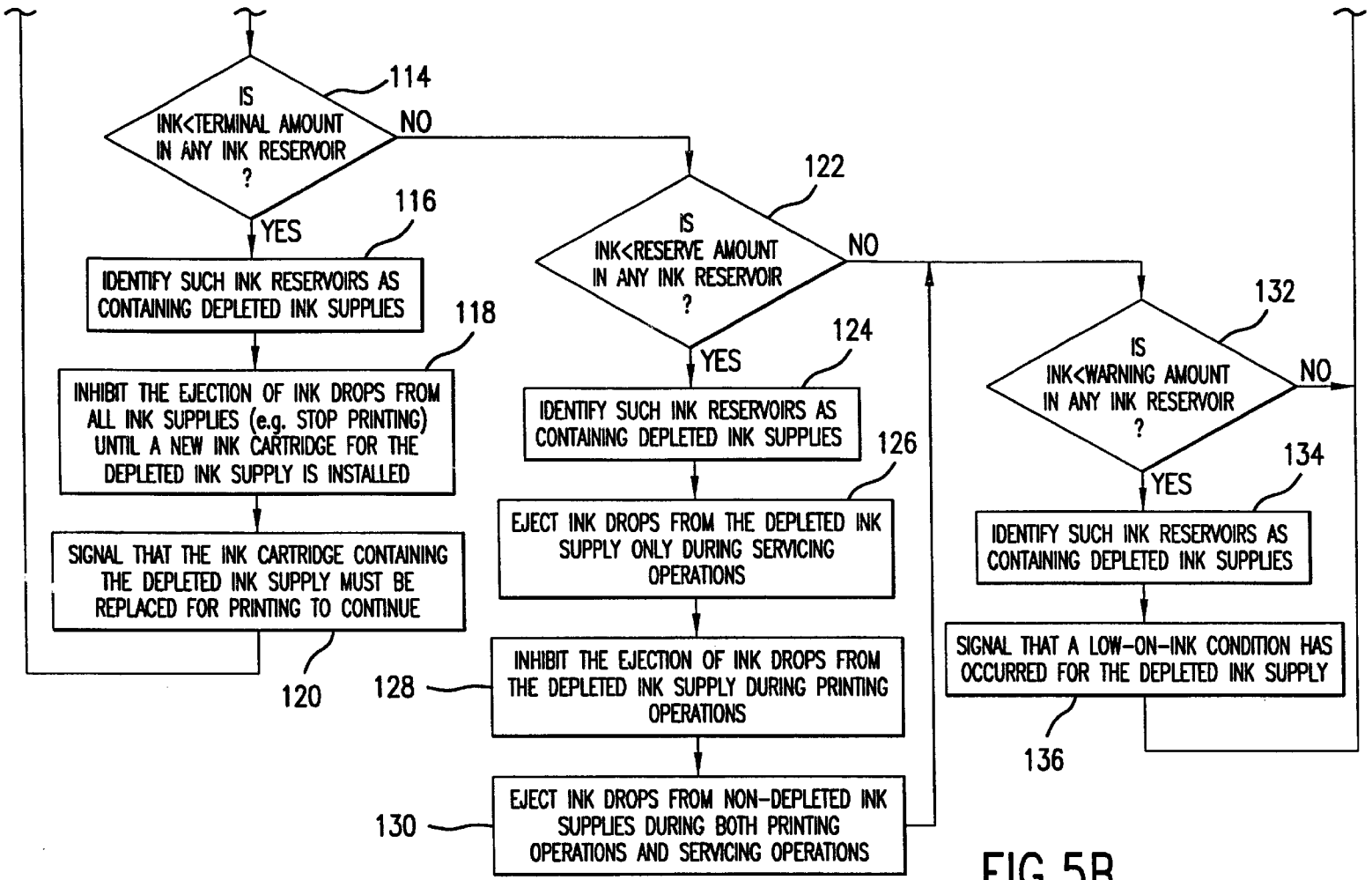

Considering the novel printing method 100 in greater detail, and with reference to FIGS. 4 and 5, the method begins at 102 by providing at least one ink cartridge 12. Each ink cartridge 12 has at least one ink reservoir 13 which contains a supply 15 of an ink. At 104, each ink cartridge 12 is installed in the printing system 10, and each ink reservoir 13 is fluidically connected to a corresponding printhead 16. Preferably the mechanical mounting arrangement is such that the fluidic coupling automatically occurs during installation of the ink cartridge. Alternatively, a tube or other fluid transport arrangement (not shown) may be connected between each ink reservoir 13 and the associated printhead 16. At 106, ejection of ink drops from the ink supplies 15 in all ink reservoirs 13 of each ink cartridge 12 is enabled. At 108, a swath of data to be printed is received at the print controller 29. Typically the data swath is provided to the printing system 10 by a computing apparatus (not shown).

At 110, the data swath is printed and the printheads 16 are serviced. Printing and servicing is performed by selectively ejecting drops of ink from the appropriate ink supplies 15 in ink reservoirs 13 through the corresponding printhead 16. The controller 29 controls the movement of the printhead along the slide rod 26 and controls the relative movement of the printhead 16 and print medium 22, and activates the printhead 16 to selectively deposit ink on the print medium 22 during a printing operation, or into the spittoon 54 during a servicing operation. At 112, the amount of ink remaining in the ink supply 15 of each of the ink reservoirs 13 is monitored. If the amount of ink in any ink reservoir is less than a terminal amount of ink ("Yes" branch of 114), then at 116, any such ink reservoirs 13 are identified as containing ink supplies 15 which are depleted. A "terminal amount" of ink is defined as a amount sufficiently low that, if printing were to continue, there would be a significant risk of damaging the corresponding printhead 16. Therefore, at 118, the ejection of ink drops from all ink supplies 15 in the printing system 10 is inhibited until a new ink cartridge for the depleted ink supply is installed—in other words, all printing ceases. At 120, the printing system 10 signals that the ink cartridge 12 containing the depleted ink supply 15 must be replaced in order for printing to resume. Such signaling may be accomplished by activating an indicator on the printing system 10 that can be seen by the user, or by communicating the status of the printing system 10 to a computing apparatus such as a personal computer (not shown) which is coupled to the printing system 10 and which has a monitor or other arrangement for displaying status information to the user. The signaling preferably identifies which ink supply 15 is depleted or which ink cartridge must be replaced. The method continues at 104 with the installation of a replacement ink cartridge 12 for the depleted ink supply 15.

If the amount of ink in all ink reservoirs is not less than a terminal amount of ink ("No" branch of 114), then at 122 it is determined whether the amount of ink in any ink reservoir is less than a reserve amount of ink. A "reserve amount" of ink is defined as an amount which is sufficiently low that, if printing using the corresponding ink supply 15 were to continue, the remaining amount of ink in the ink supply 15 would likely decrease to the terminal amount level after the printing of only a relatively few number of additional pages. A preferred embodiment sets the reserve amount at about 100 milligrams for black ink, and about 25 milligrams for cyan, magenta, and yellow inks. Therefore, when less than a reserve amount of ink is detected ("Yes" branch of 122), the inventive method 100 takes appropriate actions to continue printing for an extended period of time without replacing the ink cartridge 12 containing the depleted ink supply 15 and without damage to any of the printing elements of the printing system. These actions begin, at 124, with identifying any such ink reservoirs 13 as containing depleted ink supplies 15. At 126 and 128, the operation of the printing system 10 is modified such that ink drops will be ejected from the depleted ink supply 15 only during the servicing operations performed at 110, not during the printing operations performed at 110. In an alternate embodiment, the printing system 10 may also signal the user that the depleted ink supply 15 will no longer be used for printing operations. At 130, the ejection of ink drops from other, non-depleted ink supplies remains enabled during both the printing operations and the servicing operations of 110, and the method continues at 132.

If the amount of ink in all ink reservoirs is not less than a reserve amount of ink ("No" branch of 122), then at 132 it is determined whether the amount of ink in any ink reservoir 13 is less than a warning amount of ink. A "warning amount" of ink is defined as an amount which is sufficiently low that, as printing using the corresponding ink supply 15 continues, the remaining amount of ink in the ink supply 15 will likely decrease to the reserve amount level after the printing of only a relatively few number of additional pages. At 134, any such ink reservoirs 13 are identified as containing ink supplies 15 which are depleted. At 136, the printing system 10 signals that the ink cartridge 12 containing the depleted ink supply 15 is approaching the time when the operation of the printing system 10 will be modified to continue printing but at a reduced image quality level due to the inhibiting of ink drop ejection from the depleted ink supply 15 during printing operations. Such signaling may be accomplished by activating an indicator arrangement (not shown) on the printing system 10 that can be seen by the user, or by communicating the status of the printing system 10 to a computing apparatus such as a personal computer (not shown) which is coupled to the printing system 10 and which has a monitor or other arrangement for displaying status information to the user. The signaling preferably identifies which ink supply 15 is depleted or which ink cartridge must soon be replaced in order to continue printing with high image quality. The method continues monitoring the remaining amount of the inks at 112, as is also done if the amount of ink in all ink reservoirs is not less than a warning amount of ink ("No" branch of 132). If the amount of remaining ink falls below the warning amount or the reserve amount in one ink reservoir 13, the printing method 100 continues to monitor the ink level in other reservoirs 13 for the various conditions of depletion.

Steps 106 through 136 of method 100 are preferably performed by a computing apparatus such as controller 29, and implemented in firmware or software which is executable by the computing apparatus.

Considering now in further detail the ink level detection arrangement of the printing system 10, and with reference to FIGS. 1, 2, and 4, one preferred embodiment of the ink level detection arrangement includes at least one sensor, indicated generally at 82, disposed in the printing system 10 and sensorally coupled (or coupleable) to the ink reservoirs 13 for determining whether the amount of the ink in each reservoir 13 is less than the warning, reserve, and terminal threshold amounts heretofore described. The at least one sensor 82 may be a sensor 82*b* disposed on each individual printhead 16. Examples of such a sensor 82*b* are disclosed in U.S. Pat. No. 5,682,183, by Wade et al., titled "Ink Level Sensor for an Inkjet Print Cartridge" and U.S. Pat. No. 5,699,090, by Wade et al., titled "Out of Ink Detector for a Thermal Inkjet Printer", both of which are assigned to the assignee of the present invention and hereby incorporated by reference in their entirety. Alternatively, the at least one sensor 82 may be a sensor 82*a* mounted in the printing system and intermittently positionable in sensory proximity to the at least one ink cartridge 12. An example of such a sensor 82*a* is disclosed in U.S. Pat. No. 5,757,390, by Gragg et al., titled "Ink Volume Sensing and Replenishing System", which is assigned to the assignee of the present invention and hereby incorporated by reference in its entirety. Another embodiment of the at least one sensor 82 may be one or more sensors 82*c* disposed on each ink cartridge 12. Typically sensor 82*c* capacitively senses the ink level remaining in the corresponding ink reservoir 13.

Another preferred embodiment of the ink level detection arrangement includes a data storage arrangement in the printing system 10 for storing ink usage information corresponding to the drop ejection. The data storage arrangement is coupled to the controller 29, which uses the stored ink usage information to calculate whether the amount of the ink in each reservoir 12 is less than any of the predetermined threshold levels as heretofore described. The data storage arrangement may include a single memory 80*b* in the printing system, or preferably may include a memory device 80*a* mounted on each ink cartridge 12. Each memory device 80*a* mounted on an ink cartridge 12 stores ink usage parameters for the ink reservoirs 13 which are contained in the corresponding ink cartridge 12. In some embodiments, the ink usage parameters may include the amount of ink initially contained in a reservoir 13, the amount of ink ejected from the reservoir 13 to date, and the amount of ink remaining in the reservoir 13. The amount of ink may be represented as a drop count, a unit of mass, or a unit of volume. The controller 29 also updates the ink usage parameters appropriately following printing and servicing operations. Examples of a memory device 80*a* and its usage are disclosed in U.S. Pat. No. 5,812,156, by Bullock et al., titled "Apparatus Controlled by Data from Consumable Parts with Incorporated Memory Devices" and U.S. Pat. No. 5,835,817, by Bullock et al., titled "Replaceable Part with Integral Memory for Usage, Calibration, and Other Data", both of which are assigned to the assignee of the present invention and hereby incorporated by reference in their entirety.

The usage of sensors and data storage arrangements to perform ink level detection are not exclusive, but rather they may be effectively combined in a printing system 10. For example, the printing system 10 may use ink usage parameters in a data storage arrangement to calculate a coarse measure of remaining ink, then perform sensor measurements for a fine measure of remaining ink as ink usage nears one of the depletion thresholds heretofore described.

Figure 6:
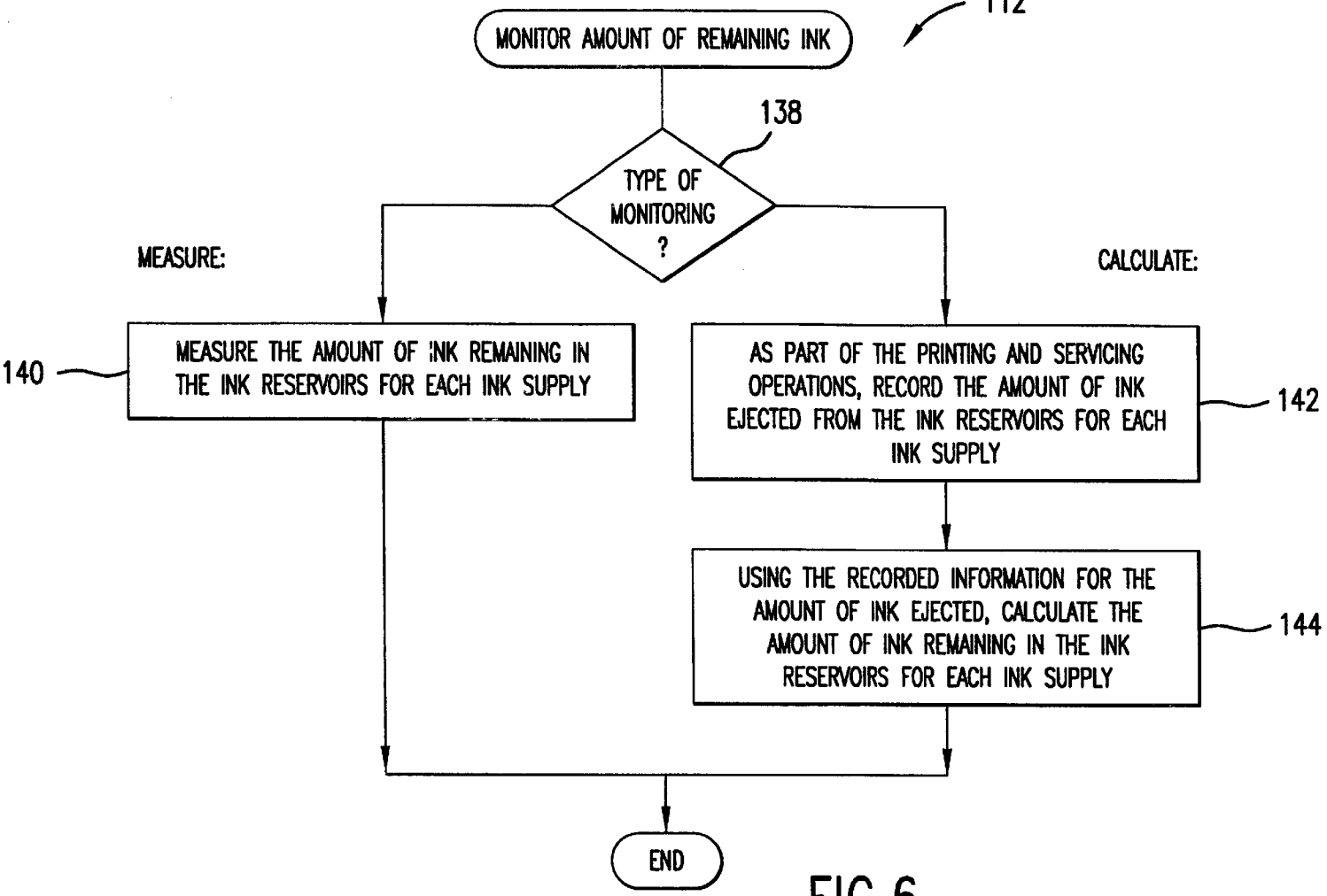
FIG. 6 is a more detailed flowchart of a portion of the printing method of FIG. 5 concerned with monitoring the amount of ink remaining in an ink reservoir of FIGS. 3A–B.

Bearing in mind the previous discussion of the ink level detection arrangement, and with reference to FIG. 6, the method step 112 of monitoring the amount of remaining ink has two alternatives at 138. If the data storage arrangement is used ("Calculate" branch of 138), then at 142 the amount of ink ejected from the ink reservoirs 13 as part of the printing and servicing operations is recorded, and at 144 the recorded information for the amount of ink ejected is used to calculate the amount of ink remaining in the ink reservoirs 13 for each ink supply 15. If a sensor is used ("Measure" branch of 138), then at 140 the amount of ink remaining in the ink reservoirs 13 for each ink supply 15 is measured.

Considering now in further detail the drop ejection arrangement of the printing system 10, and with reference to FIG. 4, in one preferred embodiment the controller 29 removes data corresponding to the ink in the depleted ink supply 15 from each swath of print data according to a print data processing algorithm 84*a* in response to the determination that the amount of the ink in the depleted reservoir 13 is less than the predetermined reserve level. For example, if the depleted ink supply corresponds to cyan ink, then the controller 29 removes all cyan data that is contained in the data swath. Algorithms 84*a* for removal of print data of a certain color are well known to those skilled in the art. Since all data for the depleted ink supply 15 is removed before the printing operation is performed, no ink drops will be ejected from the depleted reservoir 13 during the printing operation. However, drops will still be ejected from the depleted reservoir 13 during servicing operations.

Another preferred embodiment of the drop ejection arrangement includes a set of printmodes 84*b* which inhibit drop ejection from individual ones of the printheads during printing operations. The construction and operation of such printrmodes are well known to those skilled in the art. If a determination is made that the amount of the ink in a depleted ink reservoir 13 is less than the predetermined reserve level, the controller 29 selects a printmode 84*b* which inhibits drop ejection from the printhead 16 coupled to the ink reservoir 13 for the depleted ink supply 15. However, drops will still be ejected from the depleted reservoir 13 during servicing operations.

Figure 7:
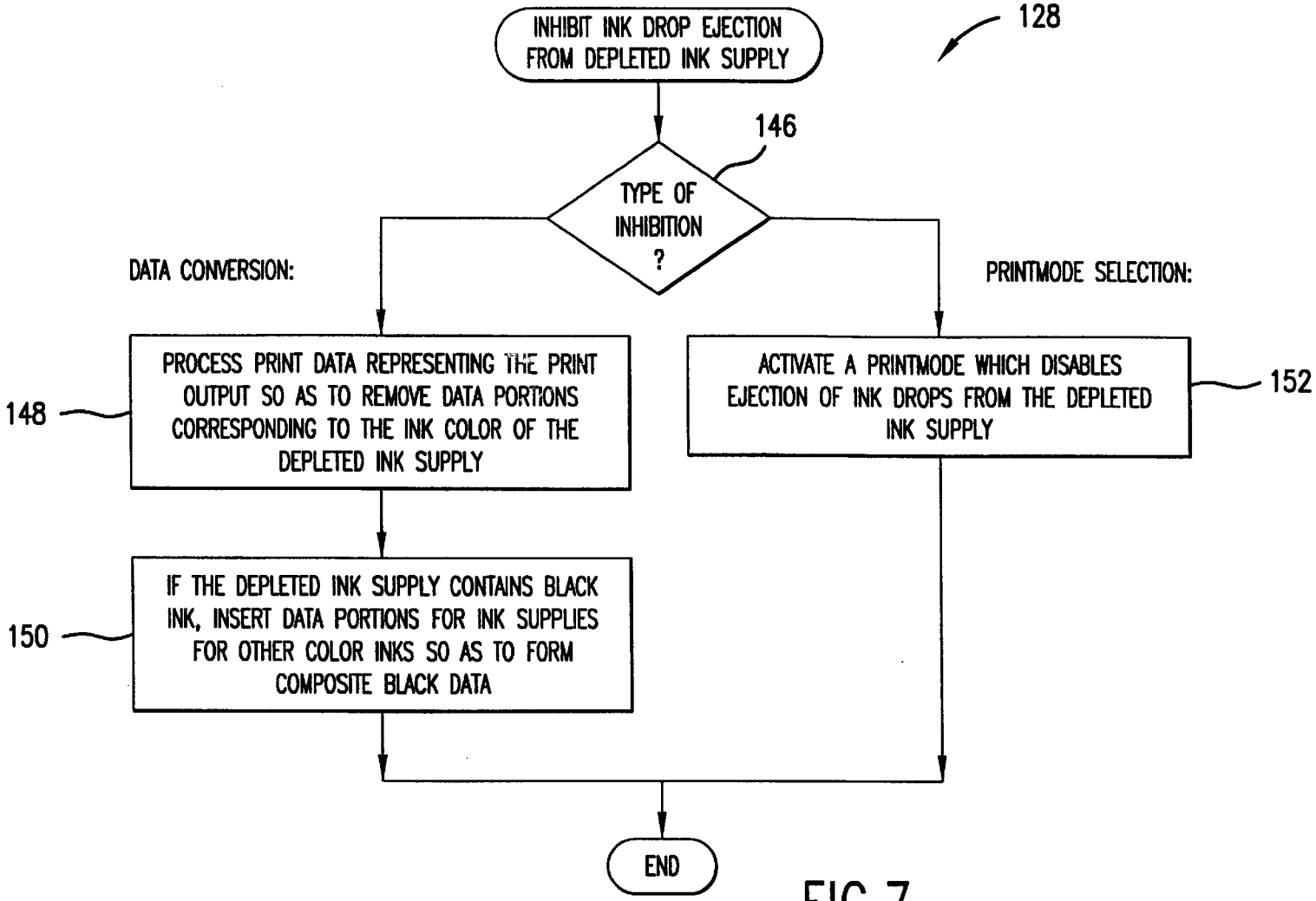
FIG. 7. is a more detailed flowchart of a portion of the printing method of FIG. 5 concerned with inhibiting ink drop ejection from a depleted ink supply in an ink reservoir of FIGS. 3A–B.

Bearing in mind the previous discussion of the ink level detection arrangement, and with reference to FIG. 7, the method step 128 of inhibiting drop ejection from the depleted ink supply has two alternatives at 146. If data removal is used ("Data Conversion" branch of 146), then at 148 data representing the print output is processed so as to remove data portions corresponding to the ink color of the depleted ink supply 15. In some embodiments, if the depleted ink supply 15 contains black ink, at 150 data portions for other ink supplies such as cyan, magenta, and yellow inks are inserted at locations where black data was removed so as to form a composite black color on the print medium 22 by printing cyan, magenta, and yellow inks in the same locations. If a different printmode is used ("Printmode Selection" branch of 146), then at 152 a printmode 84*b* which disables ejection of ink drops from the depleted ink supply 15 is activated.

From the foregoing it will be appreciated that the printing system and method provided by the present invention represent a significant advance in the art. Although several specific embodiments of the invention have been described and illustrated, the invention is not limited to the specific methods, forms, or arrangements of parts so described and illustrated. In particular, while the ink cartridges 12 have been described as located in the scanning carriage 20, the invention is not limited to this configuration, but also includes a configuration where the ink cartridges 12 may be located off the scanning carriage 20, with the ink reservoirs 12 fluidically coupled to the printheads 16 via a flexible coupling arrangement. The invention is limited only by the claims.

What is claimed is:

1. A method of printing with an inkjet printing system having a plurality of ink supplies, comprising:

detecting the presence of less than a predetermined reserve amount of ink for a depleted one of the ink supplies;

ejecting ink drops from the depleted one of the ink supplies during only a servicing operation; and ejecting ink drops from others of the ink supplies during both a printing operation and the servicing operation.

2. The method of claim 1, further comprising:

detecting the presence of less than a predetermined terminal amount of ink for the depleted one of the ink supplies, the terminal amount less than the reserve amount; and inhibiting the ejection of ink drops from all of the ink supplies.

3. The method of claim 2, wherein the inhibiting continues until a new ink cartridge is installed in the inkjet printing system.

4. The method of claim 1, further comprising:

detecting the presence of less than a predetermined warning amount of ink for the depleted one of the ink supplies, the warning amount greater than the reserve amount; and signaling that a low-on-ink condition has occurred for the depleted one of the ink supplies.

5. The method of claim 1, wherein the servicing operation includes ejecting sufficient ink drops from at least some of the ink supplies so as to maintain proper operation of the inkjet printing system.

6. The method of claim 1, wherein the detecting includes: measuring the amount of the ink remaining in each of the ink supplies.

7. The method of claim 1, wherein the detecting includes:

recording the amount of ink ejected from each of the ink supplies.

8. The method of claim 1, wherein the ejecting ink drops from the depleted one of the ink supplies during only a servicing operation includes:

inhibiting the ejection of ink drops from the depleted one of the ink supplies during the printing operation.

9. The method of claim 8, wherein the each of the ink supplies has an ink color, and wherein the inhibiting includes:

processing print data so as to remove data portions corresponding to the ink color of the depleted one of the ink supplies.

10.The method of claim 8, wherein the depleted one of the ink supplies has black color ink and others of the ink supplies have other color inks combinable after drop ejection to form a composite black color, and wherein the inhibiting further comprises:

processing data representing the print output so as to replace black data portions corresponding to the black color ink with composite data portions corresponding to the other color inks.

11. The method of claim 8, wherein the inhibiting the ejection of ink drops from the depleted one of the ink supplies during the printing operation includes:

activating a printmode which disables the ejection of ink drops from the depleted one of the ink supplies.

12. A method of printing with an inkjet printing system having a plurality of ink supplies, comprising:

detecting the presence of less than a predetermined threshold amount of ink for a depleted one of the ink supplies;

using other ones of the ink supplies for both printing and servicing operations; and using the depleted one of the ink supplies only for servicing operations.

13. A method for extending the useful life of a multiple-reservoir ink cartridge for inkjet printing system, comprising:

monitoring an amount of remaining ink in each reservoir following printing and servicing operations of the printing system;

determining that the amount of remaining ink in a depleted one of the reservoirs is less than a reserve amount;

performing servicing operations using all the reservoirs; and performing printing operations using only non-depleted ones of the reservoirs, so as to reduce ink consumption for the depleted one of the reservoirs.

14. The method of claim 13, further comprising:

determining that the amount of remaining ink in the depleted one of the reservoirs is less than a terminal amount; and preventing printing and servicing operations until the ink cartridge is replaced.

15. An inkjet printing system, comprising:

at least one ink cartridge, each ink cartridge having at least one ink reservoir for holding a supply of an ink;

at least one printhead fluidically coupled to a corresponding one of the ink reservoirs for ejecting drops of the corresponding ink;

ink level detection means for determining whether the amount of the ink in each reservoir is less than a predetermined reserve level; and drop ejection means responsive to the determination that the amount of the ink in a depleted one of the ink reservoirs is less than the predetermined reserve level, the drop ejection means for inhibiting drop ejection from the corresponding printhead during a printing operation but enabling drop ejection during a servicing operation.

16. The inkjet printing system of claim 15, wherein at least one ink cartridge has at least two ink reservoirs.

17. The inkjet printing system of claim 16, wherein a first ink cartridge has a single ink reservoir for a supply of black ink, and wherein a second ink cartridge has three ink reservoirs for supplies of cyan, magenta, and yellow inks.

18. The inkjet printing system of claim 16, wherein a first ink cartridge has three ink reservoirs for supplies of dark cyan, light cyan, and black inks, and wherein a second ink cartridge has three ink reservoirs for supplies of dark magenta, light magenta, and yellow inks.

19. The inkjet printing system of claim 16, wherein each ink cartridge has a single ink reservoir for a supply of a different color ink.

20. The inkjet printing system of claim 15, wherein the printhead is a semi-permanent printhead detachable from the ink cartridge.

21. An inkjet printing system, comprising:

at least one ink cartridge, each ink cartridge having at least one ink reservoir for holding a supply of a colored ink;

at least one printhead fluidically coupled to a corresponding one of the ink reservoirs for ejecting drops of the corresponding colored ink;

at least one sensor sensorally coupled to the at least one ink reservoir for determining whether the amount of the ink in each reservoir is less than a predetermined reserve level; and drop ejection means responsive to the determination that the amount of the ink in a depleted one of the ink reservoirs is less than a predetermined reserve level, the drop ejection means for inhibiting drop ejection from the corresponding printhead during a printing operation but enabling drop ejection during a servicing operation.

22. The inkjet printing system of claim 21, wherein each individual one of the at least one sensor is disposed on a different one of the printheads.

23. The inkjet printing system of claim 21, wherein each individual one of the at least one sensor is disposed on a different one of the ink cartridges.

24. The inkjet printing system of claim 21, wherein the at least one sensor is mounted in the printing system and intermittently positionable in sensory proximity to the at least one ink cartridge.

25. An inkjet printing system, comprising:

at least one ink cartridge, each ink cartridge having at least one ink reservoir for holding a supply of an ink;

at least one printhead fluidically coupled to a corresponding one of the ink reservoirs for ejecting drops of the corresponding ink;

a controller communicatively coupled to the at least one printhead for controlling drop ejection, and communicatively coupled to a data storage arrangement for storing ink usage information corresponding to the drop ejection, the controller further calculating from the stored ink usage information whether the amount of the ink in each reservoir is less than a predetermined reserve level; and drop ejection means responsive to the determination that the amount of the ink in a depleted one of the ink reservoirs is less than a predetermined reserve level, the drop ejection means for inhibiting drop ejection from the corresponding printhead during a printing operation but enabling drop ejection during a servicing operation.

26. The inkjet printing system of claim 25, wherein the data storage arrangement includes:

at least one memory device, each memory device mounted on a corresponding individual one of the ink cartridges.

27. The inkjet printing system of claim 26, wherein an individual memory device stores ink usage parameters for the ink reservoirs in the corresponding ink cartridge.

28. An inkjet printing system, comprising:

at least one ink cartridge, each ink cartridge having at least one ink reservoir for holding a supply of an ink;

at least one printhead fluidically coupled to a corresponding one of the ink reservoirs for ejecting drops of the corresponding ink;

ink level detection means for determining whether the amount of the ink in each reservoir is less than a predetermined reserve level; and a controller communicatively coupled to the at least one printhead for controlling drop ejection, the controller selecting a printmode which inhibits drop ejection from a depleted one of the ink reservoirs during a printing operation but not a servicing operation in response to the determination that the amount of the ink in the depleted reservoir is less than the predetermined reserve level.

29. An inkjet printing system, comprising:

at least one ink cartridge, each ink cartridge having at least one ink reservoir for holding a supply of an ink;

at least one printhead fluidically coupled to a corresponding one of the ink reservoirs for ejecting drops of the corresponding ink;

ink level detection means for determining whether the amount of the ink in each reservoir is less than a predetermined reserve level; and a controller communicatively coupled to the at least one printhead for controlling drop ejection, the controller removing data corresponding to the ink in a depleted one of the ink reservoirs from a swath of print data in response to the determination that the amount of the ink in the depleted reservoir is less than the predetermined reserve level.

30. An inkjet printing system, comprising:

at least one ink cartridge, each ink cartridge having at least one ink reservoir for holding a supply of an ink;

at least one printhead fluidically coupled to a corresponding one of the ink reservoirs for ejecting drops of the corresponding ink;

ink level detection means for determining the amount of the ink in each ink reservoir; and drop ejection means responsive to the amount of the ink in a depleted one of the ink reservoirs being less than a predetermined reserve level for inhibiting drop ejection from the corresponding printhead during a printing operation but enabling drop ejection during a servicing operation.

31. A method for extending the useful life of a multiple-reservoir ink cartridge for an inkjet printing system, comprising:

monitoring an amount of remaining ink in each reservoir following printing and servicing operations of the printing system;

determining whether the amount of remaining ink in a depleted one of the reservoirs is less than a reserve amount; and if the amount of remaining ink in the depleted one of the reservoirs is less than the reserve amounts, performing servicing operations using all the reservoirs; and performing printing operations using only non-depleted ones of the reservoirs, so as to reduce ink consumption for the depleted one of the reservoirs.

* * * * *